United States Patent [19]

Brownlee

[11] 4,123,988

[45] Nov. 7, 1978

[54] ROAD CONDITION INDICATOR DEVICE

[75] Inventor: David A. Brownlee, Pittsburgh, Pa.

[73] Assignee: Biways, Inc., Pittsburgh, Pa.

[21] Appl. No.: 794,535

[22] Filed: May 6, 1977

[51] Int. Cl.[2] ..... G09F 11/02

[52] U.S. Cl. ..... 116/133

[58] Field of Search ..... 116/130, 131, 133; 40/77.4, 77.6; 235/106, 110, 114

[56] References Cited

U.S. PATENT DOCUMENTS

| | | | |
|---|---|---|---|
| 1,468,235 | 9/1923 | Japy | 116/133 |
| 2,492,592 | 12/1949 | Perry et al. | 40/77.4 X |
| 3,864,857 | 2/1975 | Brude | 40/77.4 |

FOREIGN PATENT DOCUMENTS

| | | | |
|---|---|---|---|
| 177,107 | 3/1922 | United Kingdom | 235/110 |

*Primary Examiner*—Charles A. Ruehl

*Attorney, Agent, or Firm*—Buell, Blenko & Ziesenheim

[57] ABSTRACT

The specification discloses an indicia display device adapted for use in motor vehicles. The indicia are displayed on individually adjustable wheels which will not move when the device is vibrated, can be easily adjusted by the operator and can be easily seen at night as well as in daylight.

3 Claims, 7 Drawing Figures

ROAD CONDITION INDICATOR DEVICE

This invention relates to indicia display devices more particularly the type used in motor vehicles to record the location of road hazards or other points of interest or requiring attention.

The indicia display devices of the prior art comprise, generally, a plurality of indicia carrying wheels having knurled sides or notches to facilitate rotation of the wheels. Such devices utilize a shaft or pairs of retaining arms to engage individual wheels so that they may be rotated to expose the desired indicia on their surface. A problem encountered in using these devices is that the indicia carrying wheels may move when the device is vibrated or bumped. To restrain the wheels from inadvertent movement, the prior art has provided oversized, tight-fitting shafts (see Bryant, et al., U.S. Pat. No. 3,776,177) and spring detents which engage notches in the edge of the wheel (see Egner U.S. Pat. No. 3,310,025 and Perry, et al., U.S. Pat. No. 2,492,592).

Indicia display devices have previously been used to set mileage, telephone numbers and game scores in situations where it is inconvenient to use a pencil and paper. Many people have such devices in their automobiles because they can easily be used by the driver. Such devices are generally expensive to manufacture and easily broken. In addition, the devices cannot be used at night without the aid of an external light source.

I provide an indicia display device of simplified construction in which the indicia carrying means will not move under vibration. I provide a housing having aperatures therein. I further provide retaining means which retain indicia carrying wheels to permit the indicia on each wheel to be viewed through an aperture. I further provide at least one index arm extending from the housing to engage grooves provided in the end surface of each indicia carrying wheel thereby holding the wheel in place until the operator rotates it with his thumb or finger.

I presently prefer to arrange the wheels in several rows in a manner in which the wheels in one row have the same axis of rotation and the axes of rotation of wheels in adjacent rows are at right angles. This arrangement reduces the chances that the operator will inadvertently move a given wheel while rotating a wheel in an adjacent row.

I also prefer to provide illumination means and a combination of opaque and translucent construction materials to permit the indicia indicating means to be easily viewed at night.

I prefer to make all parts of plastic by injection molding. I further prefer to design these parts in a manner which allows them to be snapped together. This permits the entire device to be manufactured inexpensively.

Other details, objects and advantages of the invention will become apparent as the following description of a present preferred embodiment thereof proceeds.

In the accompanying drawings, I have shown a present preferred embodiment of the invention, wherein.

Figure 1:
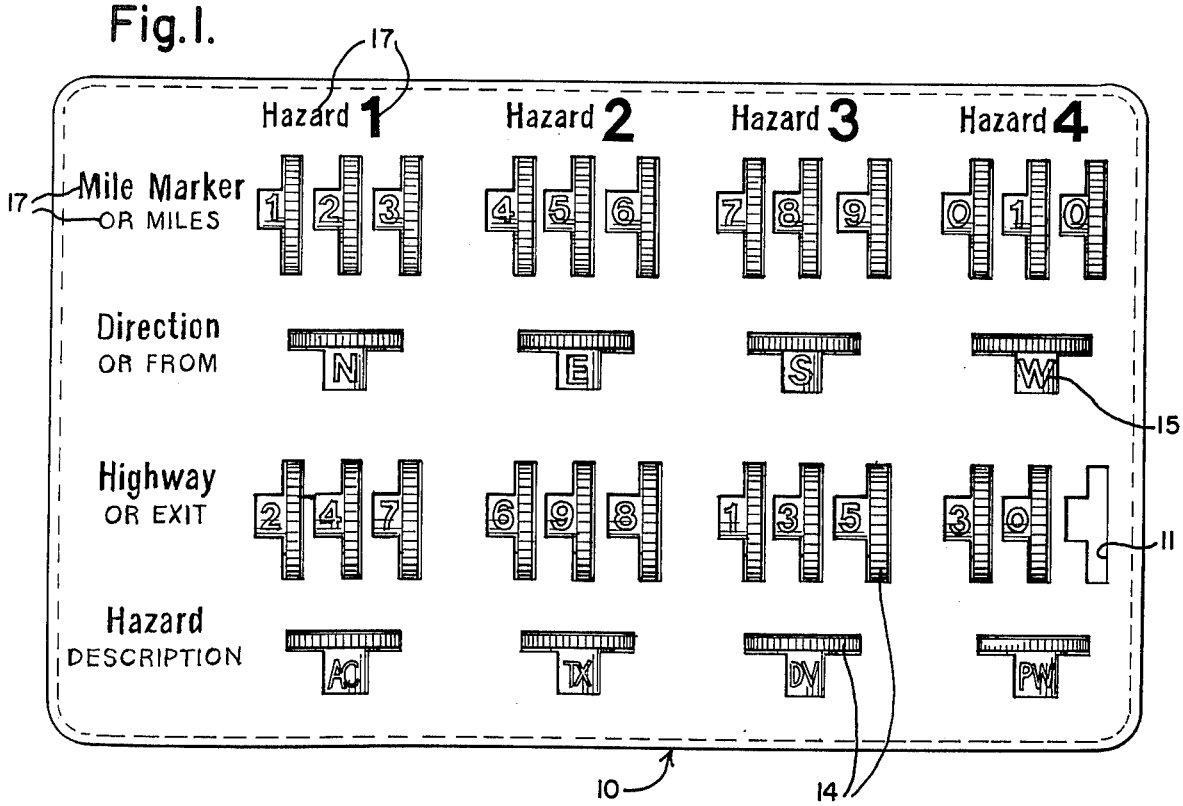
FIG. 1 is a front elevational view of a present preferred embodiment of the device.

Referring to FIG. 1, the front of the display device there shown comprises a housing having a front panel 10 in which several apertures 11 have been provided. Indicia indicating wheels 14 are inserted into the aperture 11 and held in place as explained below. The wheels 14 are arranged in rows whereby the axis of rotation for the wheels in a given row is at right angles to the axis of rotation of the wheels in adjacent rows. Such an arrangement minimizes the likelihood that an operator will inadvertently move a wheel while attempting to change another wheel in an adjacent row. Appropriate wheel indicia 15 and front panel labels 17 are provided so that the desired records can be maintained on the device. The indicia 15 and labels 17 here shown are designed to enable a CB radio operator to record the locations of road hazards of which he becomes aware via reports from drivers over the citizen band airwaves or sees as he drives. Having received and recorded this information, the CB radio operator will be prepared to adjust his driving or route so as to avoid the hazard or broadcast the information to other drivers over his CB radio.

Figure 2:
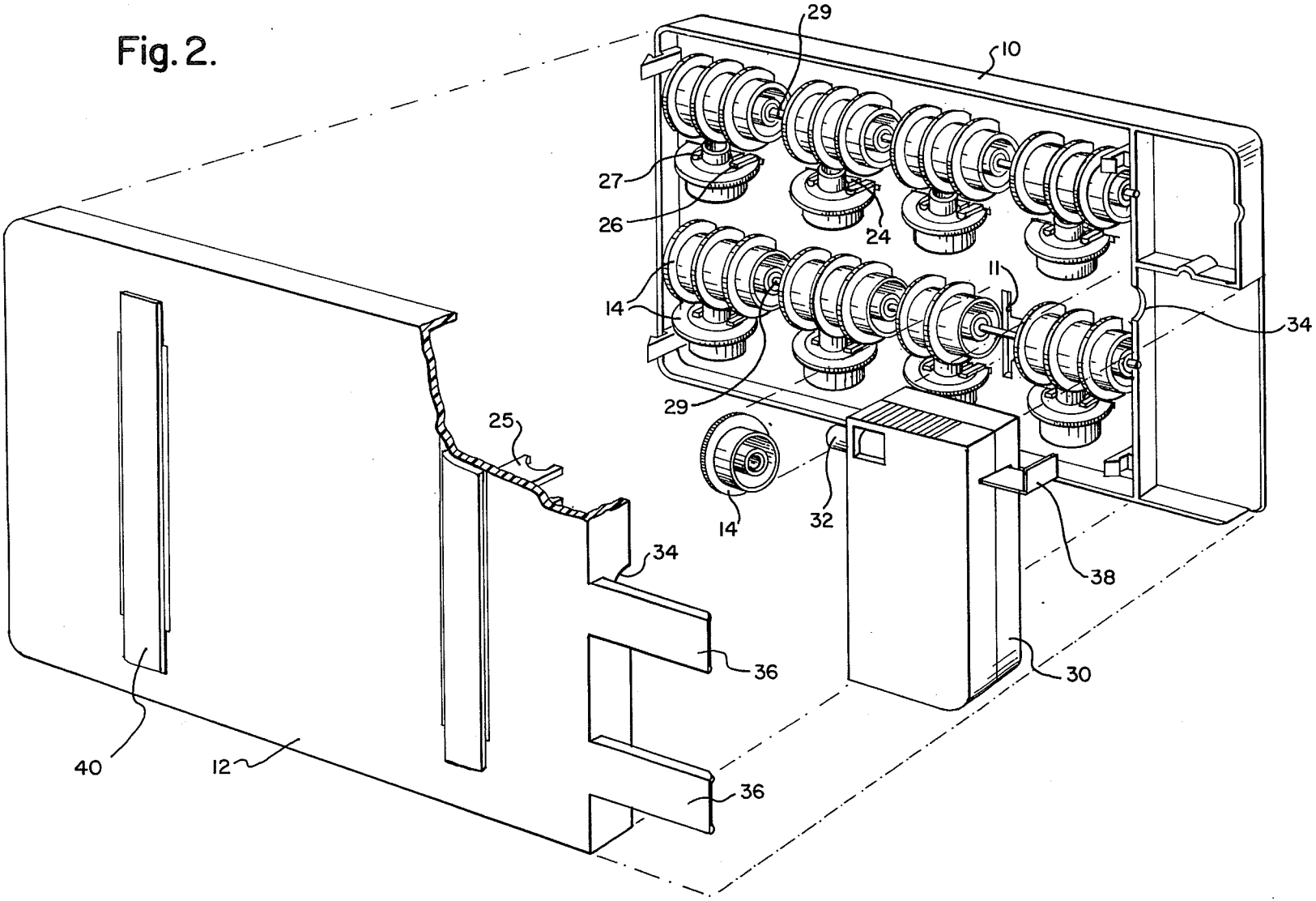
FIG. 2 is an exploded isometric view of the apparatus of FIG. 1 showing the method of assembly of the various parts of the apparatus.

In FIG. 2 the arrangement of the components of the device is shown in exploded isometric form with the back panel 12 of the housing in the foreground. The indicating wheels 14 are inserted into the aperture 11 in the front panel 10 of the housing. The wheels 14 are held in place by a complementary set of retaining arms 24 and 25 attached to the front and back panels 10 and 12 of the housing. Wheels in the same plane and having the same axis of rotation can be held in place by a shaft 29 through their center. For each wheel 14 a pair of index arms 26 and 27 is mounted to the housing 10 near the aperture 11 in which the wheel 14 is located. The arms 26 and 27 engage the wheel 14 to keep it from freely moving. An illumination means 30 is designed to fit between the front and back panels, 10 and 12, at one side of the device. The illumination means comprises a box for holding small batteries, a switch 38 and lightbulb 32. A receptacle 34 is provided in the wall of the front and back panels, 10 and 12, for receipt of the lightbulb 32 of the illumination means 30. The switch 38 is located on the illumination means 30 to permit the lightbulb 32 to be turned off and on without removing the illumination means 30 from between the housing panels 10 and 12. Strips of tape 40 are provided on the back panel 12 of the device to permit attachment of the device to the dashboard or other suitable location. Magnets or clips might also be provided in place of the tape 40. Retaining arms 36 for the illumination means 30 can be attached to the back panel 12 thereby reducing the amount of material needed for the back panel 12.

Figure 3:
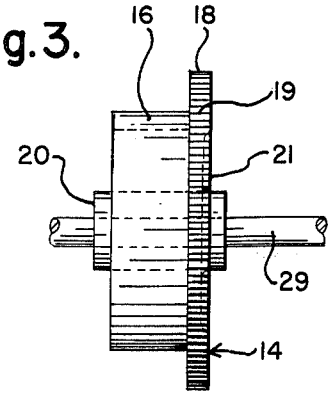
FIGS. 3 and 4 are enlarged side and front views of the indicia carrying wheel.
Figure 4:
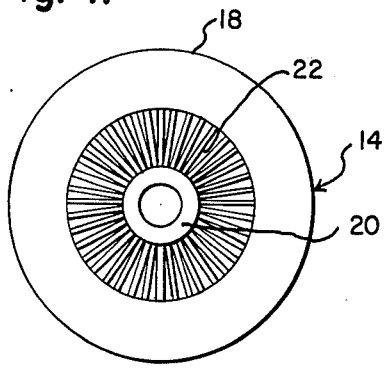

Referring primarily to FIGS. 3 and 4, the indicia carrying wheel 14 is comprised of a cylindrical body member 16, having at least one closed end 21. A hub 20 extends through the center of the cylindrical body member 16. An annular flange 18 is provided at one end of the cylindrical body member 16, and a knurled surface 19 is provided on the edge of the flange 18 to facilitate manual turning of the wheel 14. Radial grooves 22 are provided on the closed end surface 21 of the wheel 14 extending from the hub 20. Studs 28 located on the ends of the index arms 27 (see FIG. 6) engage the radial grooves 22 to prevent rotation unless the wheel 14 is manually rotated. The index arms 27 flex to facilitate studs 28 to move in and out of the radial grooves 22.

Figure 5:
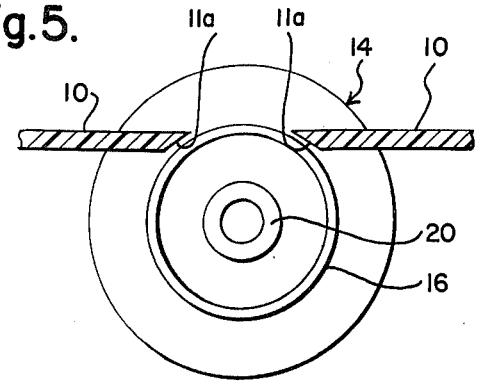
FIG. 5 is a cross sectional view of a portion of the front panel showing the indicia carrying wheel in the aperature of the front panel.

FIG. 5 shows the indicia carrying wheel 14 inserted into the aperture 11 of the front panel 10. The aperture 11 has convex walls 11*a* permitting the outermost surface of the cylindrical body member 16 of the wheel 14 to be in the same plane as the outer edge of the front panel 10. This arrangement prevents a shadow from being cast upon the cylindrical body member 16 from an external light source which would create difficulty in reading the indicia 15 printed on the cylindrical body member 16 of the wheel 14.

Figure 6:
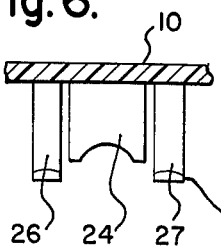
FIG. 6 is an enlarged top plan view of the retaining arm and indexing arms.
Figure 7:
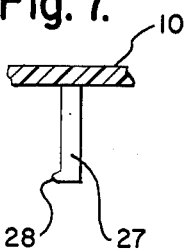
FIG. 7 is an enlarged side view of the index arm.

Referring to FIGS. 6 and 7, the retaining arm 24 is designed to receive the hub 20 of the wheel 14. For each wheel 14 two retaining arms 24 are attached to the front panel 10 and two retaining arms 25 are attached to the back panel 12 being disposed so that they will engage the ends of the wheel hub 20 as shown in FIG. 2 for the wheels 14 in the second and fourth rows counting from the top of the drawing. If the wheels 14 in a given row have a shaft 29 passing through their center as shown in the first and third rows in FIG. 2, the retaining arms 24 and 25 may be omitted. Index arms 26 and 27 are located adjacent to each aperture 11. A stud 28 located on the end of each of the index arms 26 and 27 engages the radial grooves 22 of the wheel 14 to keep it in place until manually rotated.

While I have shown and described a present preferred embodiment of the invention, it is to be distinctly understood that the invention is not limited thereto but may be otherwise variously embodied within the scope of the following claims.

I claim:

1. An indicia display device comprising;

(a). a housing having generally front and back panels and having a plurality of apertures (b). a plurality of indicia carrying wheels adapted to fit into the apertures of the front panel comprising;

(1) a generally cylindrical body member having at least one closed end, (2) a hub extending through the center of the cylindrical body member, (3) a plurality of grooves in the end surface of the cylindrical body member, and (4) a radial flange attached to one end of the cylindrical body member for manually rotating the cylindrical body member;

(c). a set of first retainer arms attached to the front panel of the housing and adapted to receive the hub of the indicia carrying wheels;

(d). a set of second retainer arms attached to the back panel of the housing and adapted to receive the hub of the indicia carrying wheels; and (e). a set of index arms attached to the housing adapted to engage the grooves in the end surface of the indicia carrying wheels thereby preventing the wheels from turning freely.

2. That indicia display device claimed in claim 1 wherein the indicia carrying wheels are arranged in rows so that the wheels in the same row have the same axis of rotation and the axis of rotation of any given wheel is at right angles to the axis of rotation of wheels in adjacent rows.

3. An indicia display device comprising:

a. a housing having generally front and back panels and having a plurality of apertures;

b. a first set of indicia carrying wheels adapted to fit into the apertures of the front panel comprising:

1. a generally cylindrical body member having at least one closed end, 2. a hub extending through the center of the cylindrical body member, 3. a plurality of grooves in the end surface of the cylindrical body member, and 4. a radial flange attached to one end of the cylindrical body member for manually rotating the cylindrical body member;

c. a set of first retainer arms attached to the front panel of the housing and adapted to receive the hub of the first set of indicia carrying wheels;

d. a set of second retainer arms attached to the back panel of the housing and adapted to receive the hub of the first set of indicia carrying wheels;

e. at least one shaft;

f. a second set of indicia carrying wheels adapted to fit into the apertures of the front panel comprising:

1. a generally cylindrical body member having at least one closed end, 2. a hub extending through the center of the cylindrical body member and having a hole therethrough to permit it to be mounted on and rotated about a shaft, 3. a plurality of grooves in the end surface of the cylindrical body member, and 4. a radial flange attached to one end of the cylindrical body member for manually rotating the cylindrical body member, said second set of indicia carrying wheels being mounted on said at least one shaft for rotation about the shaft; and g. a set of index arms attached to the housing adapted to engage the grooves in the end surface of the first and second sets of indicia carrying wheels thereby preventing the wheels from turning freely.

* * * * *